US011124741B2

(12) United States Patent
Das et al.

(10) Patent No.: US 11,124,741 B2
(45) Date of Patent: Sep. 21, 2021

(54) CERIA REMOVAL COMPOSITIONS

(71) Applicant: ENTEGRIS, INC., Billerica, MA (US)

(72) Inventors: Atanu K. Das, Danbury, CT (US); Michael White, Ridgefield, CT (US); Daniela White, Ridgefield, CT (US)

(73) Assignee: ENTEGRIS, INC., Billerica, MA (US)

( * ) Notice: Subject to any disclaimer, the term of this patent is extended or adjusted under 35 U.S.C. 154(b) by 0 days.

(21) Appl. No.: 16/782,912

(22) Filed: Feb. 5, 2020

(65) Prior Publication Data

US 2020/0255770 A1 Aug. 13, 2020

Related U.S. Application Data

(60) Provisional application No. 62/802,986, filed on Feb. 8, 2019.

(51) Int. Cl.

| | |
|---|---|
| ***C11D 7/32*** | (2006.01) |
| ***C11D 3/36*** | (2006.01) |
| ***C11D 1/90*** | (2006.01) |
| ***C11D 3/20*** | (2006.01) |
| ***C11D 3/33*** | (2006.01) |

(52) U.S. Cl.
CPC ..... *C11D 3/364* (2013.01); *C11D 1/90* (2013.01); *C11D 3/2082* (2013.01); *C11D 3/33* (2013.01); *C11D 3/362* (2013.01)

(58) Field of Classification Search
CPC ..... C11D 11/0047
USPC ..... 510/175
See application file for complete search history.

(56) References Cited

U.S. PATENT DOCUMENTS

| | | | | |
|---|---|---|---|---|
| 6,326,305 | B1 | 12/2001 | Avanzino | |
| 7,314,578 | B2 | 1/2008 | Choi | |
| 2006/0166847 | A1 | 7/2006 | Walker | |
| 2009/0133716 | A1* | 5/2009 | Lee | H01L 21/02063 134/3 |
| 2016/0122696 | A1* | 5/2016 | Liu | C11D 3/30 257/798 |
| 2018/0204736 | A1 | 7/2018 | White | |

FOREIGN PATENT DOCUMENTS

| | | | |
|---|---|---|---|
| JP | 2017098368 | A | 6/2017 |
| JP | 2018109086 | A | 7/2018 |
| WO | 2018136511 | A1 | 7/2018 |

OTHER PUBLICATIONS

Canham, Leigh, etal.; "Characterization of Microporous Si bu Flow Calorimetry: Comparison with a hydrophobic SiO2 molecular sieve"; Journal of Applied Physics 74(4): 1558-1565; Aug. 1992.

Shah V, Shah S, Shah H, Rispoli FJ, McDonnell KT, Workeneh S, et al. (2012) Antibacterial Activity of Polymer Coated Cerium Oxide Nanoparticles. PLoS One 7(10): e47827. https://doi.org/10.1371/journal.pone.0047827.

* cited by examiner

*Primary Examiner* — Gregory E Webb
(74) *Attorney, Agent, or Firm* — Entegris, Inc.

(57) ABSTRACT

The present invention generally relates to a removal composition and process, particularly useful for cleaning ceria particles and CMP contaminants from microelectronic devices having said particles and CMP contaminants thereon, in particular microelectronic devices having PETEOS, Silicon Nitride, and Poly-Si substrates. In one aspect, the invention provides treatment of the microelectronic substrate having ceria particles thereon utilizing complexing agents free of Sulfur and Phosphorous atoms.

20 Claims, No Drawings

CERIA REMOVAL COMPOSITIONS

FIELD OF THE INVENTION

The present invention relates generally to compositions for removing ceria particles and other chemical mechanical polishing slurry contaminants from microelectronic devices having same thereon.

BACKGROUND OF THE INVENTION

Microelectronic device wafers are used to form integrated circuits. The microelectronic device wafer includes a substrate, such as silicon, into which regions are patterned for deposition of different materials having insulative, conductive or semi-conductive properties.

In order to obtain the correct patterning, excess material used in forming the layers on the substrate must be removed. Further, to fabricate functional and reliable circuitry, it is important to prepare a flat or planar microelectronic wafer surface prior to subsequent processing. Thus, it is necessary to remove and/or polish certain surfaces of a microelectronic device wafer.

Chemical Mechanical Polishing or Planarization ("CMP") is a process in which material is removed from a surface of a microelectronic device wafer, and the surface is polished (e.g., planarized) by coupling a physical process such as abrasion with a chemical process such as oxidation or chelation. In its most rudimentary form, CMP involves applying an abrasive slurry having an active chemistry to a polishing pad that buffs the surface of a microelectronic device wafer during the removal, planarization, and polishing processes. Removal or polishing processes using purely physical or purely chemical action are not as effective as the synergistic combination of both in order to achieve fast, uniform removal. In addition, in the fabrication of integrated circuits, the CMP slurry should also be able to preferentially remove films that comprise complex layers of metals and other materials so that highly planar surfaces can be produced for subsequent photolithography, or patterning, etching and thin-film processing.

In a front-end-of-the-line (FEOL) method for forming an isolation region in a silicon substrate using the shallow trench isolation (STI) process, a pad oxide film and a pad nitride film are deposited on a semiconductor substrate and patterned to expose portions of the substrate, which correspond to an isolation region. Then, the exposed regions of the substrate are etched to form a trench. Thereafter, the substrate is subjected to a sacrificial oxidation process to remove damage caused by the substrate etching followed by formation of a wall oxide film on the surface of the trench. Next, a trench-buried oxide film (e.g., an oxide film formed by high density plasma chemical vapor deposition referred to as an HDP-oxide film), is deposited on the surface of the substrate in such a manner as to be buried in the trench. Then, the surface of the HDP-oxide film is subjected to chemical mechanical polishing until the pad nitride film is exposed. The resulting substrate is then cleaned and the pad nitride film which was used as an etch barrier during the trench etch is removed, completing the formation of an isolation region.

A CMP slurry using ceria particles generally achieves a faster polishing speed for an insulator, relative to a silica-containing slurry. Moreover, a ceria-based slurry is most often used because of the ability to achieve STI pattern planarization with minimal oxide erosion. Disadvantageously, ceria-based slurries are difficult to remove from STI structures because of the oppositely charged zeta potentials of the ceria particles relative to the silicon oxide and silicon nitride surfaces. If a device is manufactured with these residues remaining on the wafer, the residues will lead to short circuits and an increase in electrical resistance. Ceria particles are also a problem with FinFET structures following CMP processing using ceria slurries.

Currently, the most efficient wet cleaning formulation for removing ceria particles is dilute hydrofluoric acid (DHF). However, DHF disadvantageously etches silicon oxide and other low-k dielectric materials.

Therefore, a need remains for a ceria particle removal composition and process that effectively removes ceria particles from a surface of a microelectronic device while not damaging the underlying materials such as silicon nitride, low-k dielectrics (e.g., silicon oxide), and tungsten-containing layers. The ceria particle removal composition should also efficaciously remove CMP slurry contaminants from the surface of the microelectronic device.

SUMMARY OF THE INVENTION

The present invention generally relates to a removal composition and method, particularly useful for cleaning ceria particles and CMP contaminants from microelectronic devices having said particles and CMP contaminants thereon, in particular microelectronic devices having PETEOS, Silicon Nitride, and Poly-Si substrates. In one aspect, the invention provides treatment of the microelectronic substrate having ceria particles thereon utilizing complexing agents free of sulfur and phosphorous atoms. In this regard, the ceria particles may be positively-charged or negatively-charged.

DETAILED DESCRIPTION OF THE INVENTION

The present invention relates generally to compositions useful for the removal of ceria particles and CMP contaminants from a microelectronic device having such material(s) thereon. The ceria particles and CMP contaminants are efficaciously removed using the compositions and further the compositions are compatible with silicon nitride and low-k dielectric (e.g., silicon oxide) layers.

In a first aspect, the invention provides a composition, comprising, consisting of, or consisting essentially of a composition as set forth herein. In one embodiment, the invention provides a composition having a pH of about 1 to about 6, comprising:

(a) a cerium-oxygen bond breaking compound;

(b) a pH adjustor;

(c) at least one cleaning agent;

(d) a ceria complexing compound selected from tartaric acid, acetyl acetone, glutamic acid, adipic acid, betaine, amino tris(methylenephosphonic) acid and nitrilo triacetic acid; and (e) water.

In the compositions of the invention, the cerium-oxygen bond breaking compound can be any conventional compound utilized for effectively breaking the cerium-oxygen chemical bond. Such compounds include oxidizing agents, reducing agents, and nucleophilic compounds.

As used herein, the term "nucleophilic compound" refers to compounds which are understood to act as nucelophiles in chemical reactions. In other words, a nucleophilic compound is a chemical species that can donate an electron pair to an electrophile to form a chemical bond in relation to a reaction.

In one embodiment, the nucleophilic compound is an amine. Examples include monoethanolamine (MEA), morpholine, isopropyl amine, diisopropanolamine, diglycolamine, triethylamine, N-methylmorpholine, methylethanolamine, N-aminopropyl morpholine, and 3-aminopropanol.

Additional nucleophilic compounds include species having the general formula $NR^1R^2R^3$, wherein $R^1$, $R^2$ and $R^3$ may be the same as or different from one another and are chosen from hydrogen, straight-chain or branched $C_1$-$C_6$ alkyl (e.g., methyl, ethyl, propyl, butyl, pentyl, and hexyl) groups, straight-chain or branched $C_1$-$C_6$ hydroxyalkyl (e.g., hydroxymethyl, hydroxyethyl, hydroxypropyl, hydroxybutyl, hydroxypentyl, and hydroxyhexyl) groups, and $C_1$-$C_6$ alkyl ethers of straight chain or branched $C_1$-$C_6$ hydroxyalkyl groups as defined above. In certain embodiments, at least one of $R^1$, $R^2$ and $R^3$ is a straight-chain or branched $C_1$-$C_6$ hydroxyalkyl group. Examples include, without limitation, alkanolamines such as aminoethylethanolamine, N-methylaminoethanol, aminoethoxyethanol, dimethylaminoethoxyethanol, diethanolamine, N-methyldiethanolamine, monoethanolamine (MEA), triethanolamine (TEA), 1-amino-2-propanol, 2-amino-1-butanol, isobutanolamine, triethylenediamine, other C1-C8 alkanolamines and combinations thereof. When the amine includes the alkylether component, the amine may be considered an alkoxyamine, e.g., 1-methoxy-2-aminoethane.

As used herein, "reducing agent(s)" contemplated include compounds chosen from hydrophosphorous acid ($H_3PO_2$), ascorbic acid, L(+)-ascorbic acid, isoascorbic acid, ascorbic acid derivatives, DEHA (diethylhydroxylamine), reducing sugar (galactose) and combinations thereof. Additionally, phosphorous acid, sulfurous acid, ammonium and potassium thiosulfate, xylose, sorbitol. N-aminomorpholine, N-aminopiperazine, hydroquinone, catechol, tetrahydrofulvalene, N,N-Dimethylanilinebenzylamine, hydroxylamine and other sulfur based reducing agents may be utilized.

As used herein, "oxidizing agents" correspond to compounds that oxidize exposed metal(s) resulting in corrosion of the metal or oxide formation on the metal. Oxidizing agents include but are not limited to: hydrogen peroxide; other percompounds such as salts and acids containing peroxomonosulfate, perborate, perchlorate, periodate, persulfate, permanganate, and peracetate anions; and amine-N-oxides.

Suitable pH adjustors include choline hydroxide, potassium hydroxide, cesium hydroxide, tetraethylammonium hydroxide, ammonium hydroxide, nitric acid, sulfuric acid, sulfamic acid, glycolic acid, lactic acid, and methanesulfonic acid.

As noted above, the composition comprises at least one cleaning agent. Said cleaning agents are chosen from at least one of (i) one or more water miscible solvent(s), and/or (ii) one or more one polymer(s), and/or citric acid.

Examples of water-miscible solvents include, glycols, and glycol ethers, including, but not limited to, methanol, ethanol, isopropanol, butanol, and higher alcohols (such as $C_2$-$C_4$ diols and $C_2$-$C_4$ triols), tetrahydrofurfuryl alcohol (THFA), halogenated alcohols (such as 3-chloro-1,2-propanediol, 3-chloro-1-propanethiol, 1-chloro-2-propanol, 2-chloro-1-propanol, 3-chloro-1-propanol, 3-bromo-1,2-propanediol, 1-bromo-2-propanol, 3-bromo-1-propanol, 3-iodo-1-propanol, 4-chloro-1-butanol, 2-chloroethanol), dichloromethane, chloroform, acetic acid, propionic acid, trifluoroacetic acid, tetrahydrofuran N-methylpyrrolidinone (NMP), cyclohexylpyrrolidinone, N-octylpyrrolidinone, N-phenylpyrrolidinone, methyldiethanolamine, methyl formate, dimethyl formamide (DMF), dimethylsulfoxide (DMSO), tetramethylene sulfone (sulfolane), diethyl ether, phenoxy-2-propanol (PPh), propriophenone, ethyl lactate, ethyl acetate, ethyl benzoate, acetonitrile, acetone, ethylene glycol, propylene glycol (PG), 1,3-propanediol, dioxane, butyryl lactone, butylene carbonate, ethylene carbonate, propylene carbonate, dipropylene glycol, diethylene glycol monomethyl ether, triethylene glycol monomethyl ether, diethylene glycol monoethyl ether, triethylene glycol monoethyl ether, ethylene glycol monopropyl ether, ethylene glycol monobutyl ether, diethylene glycol monobutyl ether (i.e., butyl carbitol), triethylene glycol monobutyl ether, ethylene glycol monohexyl ether, diethylene glycol monohexyl ether, ethylene glycol phenyl ether, propylene glycol methyl ether, dipropylene glycol methyl ether (DPGME), tripropylene glycol methyl ether (TPGME), dipropylene glycol dimethyl ether, dipropylene glycol ethyl ether, propylene glycol n-propyl ether, dipropylene glycol n-propyl ether (DPGPE), tripropylene glycol n-propyl ether, propylene glycol n-butyl ether, dipropylene glycol n-butyl ether, tripropylene glycol n-butyl ether, propylene glycol phenyl ether, ethylene glycol monophenyl ether, diethylene glycol monophenyl ether hexaethylene glycol monophenylether, dipropylene glycol methyl ether acetate, tetraethylene glycol dimethyl ether (TEGDE), dibasic ester, glycerine carbonate, N-formyl morpholine, triethyl phosphate, and combinations thereof.

Polymers, when present, include, but are not limited to, methacrylic acid homopolymer and copolymers with, for example, acrylamidomethylpropane sulfonic acid and maleic acid; maleic acid/vinyl ether copolymer; poly(vinylpyrrolidone)/vinyl acetate; homopolymers such as phosphonated polyethyleneglycol oligomers, poly(acrylic acid) (PAA), poly(acrylamide), poly(vinyl acetate), poly(ethylene glycol) (PEG), polypropylene glycol) (PPG), poly(styrene sulfonic acid), poly(vinyl sulfonic acid), poly(vinyl phosphonic acid), poly(vinyl phosphoric acid), poly(ethyleneimine), poly(propyleneimine), polyallylamine, polyethylene oxide (PEO), polyvinyl pyrrolidone (PVP), PPG-PEG-PPG block copolymers, PEG-PPG-PEG block copolymers, poly (vinyl alcohol), poly(hydroxyethyl)acrylate, poly(hydroxyethyl)methacrylate, hydroxyethyl cellulose, methylhydroxyethyl cellulose, hydroxypropyl cellulose, methylhydroxypropyl cellulose, xanthan gum, potassium alginate, pectin, carboxymethylcellulose, glucosamine, poly (diallyldimethylammonium) chloride, PEGylated (i.e., polyethyleneglycol-ated) methacrylate/acrylate copolymers, poly MADQuat and copolymers thereof, dimethylaminomethacrylate polymers and compolymers thereof, trimethylammonium methylmethacrylate polymers and copolymers thereof, and combinations thereof. The copolymers above may be random or block copolymers. When present, the amount of polymer(s) in the composition is in a range from about 0.0001 weight % to about 5 weight %, based on the total weight of the composition.

With regard to complexing agents, we have found that certain compounds as set forth above, all of which are devoid of phosphorous and sulfur atoms, are effective at complexing the ceria species, which aids in their removal from the surface of a microelectronic device. In one embodiment, these complexing agents are chosen from tartaric acid, acetyl acetone, glutamic acid, adipic acid, nitrilo triacetic acid, amino tris(methylenephosphonic acid, betaine, IDA (aminodiacetic acid), and HEDP (etodronic acid). In another embodiment, the complexing agent is acetyl acetone.

For ease of reference, "microelectronic device" corresponds to semiconductor substrates, flat panel displays, phase change memory devices, solar panels and other products including solar substrates, photovoltaics, and microelectromechanical systems (MEMS), manufactured for use in microelectronic, integrated circuit, or computer chip applications. Solar substrates include, but are not limited to, silicon, amorphous silicon, polycrystalline silicon, monocrystalline silicon, CdTe, copper indium selenide, copper indium sulfide, and gallium arsenide on gallium. The solar substrates may be doped or undoped. It is to be understood that the term "microelectronic device" is not meant to be limiting in any way and includes any substrate that will eventually become a microelectronic device or microelectronic assembly.

As used herein, "ceria particles" corresponds to cerium-based abrasive particles that may be used in chemical mechanical polishing slurries, including, for example, a cerium oxide having the formula $Ce_2O_3$ and $CeO_2$. It should be appreciated that the "ceria particles" may comprise, consist of, or consist essentially of cerium oxide.

As used herein, "contaminants" correspond to chemicals present in the CMP slurry, reaction by-products of the polishing slurry, post-CMP residue, chemicals present in the wet etching composition, reaction by products of the wet etching composition, and any other materials that are the by-products of the CMP process, the wet etching, the plasma etching or the plasma ashing process.

As used herein, "post-CMP residue" corresponds to particles from the polishing slurry, e.g., chemicals present in the slurry, reaction by-products of the polishing slurry, carbon-rich particles, polishing pad particles, brush deloading particles, equipment materials of construction particles, metal, organic, organometallic, organosilicic, or inorganic in nature, for example, silicon-containing material, titanium-containing material, nitrogen-containing material, oxygen-containing material, polymeric residue material, copper-containing residue material (including copper oxide residue), tungsten-containing residue material, cobalt-containing residue material, etch gas residue such as chlorine and fluorine, and combinations thereof and any other materials that are the by-products of the CMP process As used herein, the term "low-k dielectric material" corresponds to any material used as a dielectric material in a layered microelectronic device, wherein the material has a dielectric constant less than about 3.5. In certain embodiments, the low-κ dielectric materials include low-polarity materials such as silicon-containing organic polymers, silicon-containing hybrid organic/inorganic materials, organosilicate glass (OSG), TEOS, fluorinated silicate glass (FSG), silicon dioxide, silicon oxycarbide, silicon oxynitride, silicon nitride, carbon-doped oxide (CDO) or carbon-doped glass, for example, CORAL™ from Novellus Systems, Inc., BLACK DIAMOND™ from Applied Materials, Inc. (e.g., BD1, BD2, and BD3 designations for PECVD) SiLK™ dielectric resins from Dow (polymers based on crosslinked polyphenylenes by reaction of polyfunctional cyclopentadienone and acetylene-containing materials; see, for example, U.S. Pat. No. 5,965,679, incorporated herein by reference), and NANOGLASS™ of Nanopore, Inc, (Silica aerogel/xerogel (known as nanoporous silica), and the like. It is to be appreciated that the low-κ dielectric materials may have varying densities and varying porosities.

As used herein, the term "etchant" refers to: hydrofluoric acid (HF); fluorosilicic acid ($H_2SiF_6$); fluoroboric acid; ammonium fluorosilicate salt ($(NH_4)_2SiF_6$); tetramethylammonium hexafluorophosphate; ammonium fluoride; ammonium bifluoride; quaternary ammonium tetrafluoroborates and quaternary phosphonium tetrafluoroborates and combinations thereof.

As used therein, the term "metal corrosion inhibitors" refers to non-ionic surfactants such as PolyFox PF-159 (OMNOVA Solutions), polyethylene glycol) ("PEG"), poly (propylene glycol) ("PPG"), ethylene oxide/propylene oxide block copolymers such as Pluronic F-127 (BASF), a polysorbate polyoxyethylene (20) sorbitan monooleate (Tween 80), polyoxyethylene (20) sorbitan monostearate (Tween 60), polyoxyethylene (20) sorbitan monopalmitate (Tween 40), polyoxyethylene (20) sorbitan monolaurate (Tween 20)), polyoxypropylene/polyoxyethylene block copolymers (e.g., Pluronic L31, Plutonic 31R1, Pluronic 25R2 and Pluronic 25R4), and combinations thereof and such compounds in combination with azoles such as 5-aminotetrazole, 5-phenyl-benzotriazole, 1H-tetrazole-5-acetic acid, 1-phenyl-2-tetrazoline-5-thione, benzimidazole, methyltetrazole, Bismuthiol I, cytosine, guanine, thymine, pyrazoles, iminodiacetic acid (IDA), propanethiol, benzohydroxamic acids, citric acid, ascorbic acid, 5-amino-1,3,4-thiadiazole-2-thiol (ATDT), benzotriazole (BTA), 1,2,4-triazole (TAZ), tolyltriazole, 5-methyl-benzotriazole (mBTA), 5-phenyl-benzotriazole, 5-nitro-benzotriazole, benzotriazole carboxylic acid, 3-amino-5-mercapto-1,2,4-triazole, 1-amino-1,2,4-triazole, hydroxybenzotriazole, 2-(5-amino-pentyl)-benzotriazole, 1-amino-1,2,3-triazole, 1-amino-5-methyl-1,2,3-triazole, 3-amino-1,2,4-triazole (3-ATA), 3-mercapto-1,2,4-triazole, 3-isopropyl-1,2,4-triazole, 5-phenylthiol-benzotriazole, halo-benzotriazoles (halo=F, Cl, Br or I), naphthotriazole, 2-mercaptobenzimidazole (MBI), 2-mercaptobenzothiazole, 4-methyl-2-phenylimidazole, 2-mercaptothiazoline, 5-amino-1,2,4-triazole (5-ATA), sodium dedecyl sulfate (SDS), ATA-SDS, 3-amino-5-mercapto-1,2,4-triazole, pentylenetetrazole, 5-phenyl-1H-tetrazole, 5-benzyl-1H-tetrazole, Ablumine O, 2-benzylpyridine, succinimide, 2,4-diamino-6-methyl-1,3,5-triazine, thiazole, triazine, methyltetrazole, 1,3-dimethyl-2-imidazolidinone, 1,5-pentamethylenetetrazole, 1-phenyl-5-mercaptotetrazole, diaminomethyltriazine, imidazoline thione, 4-methyl-4H-1,2,4-triazole-3-thiol, 4-amino-4H-1,2,4-triazole, 3-amino-5-methylthio-1H-1,2,4-triazole, benzothiazole, imidazole, indiazole, adenine, succinimide, adenosine, carbazole, saccharin, uric acid, benzoinoxime, cationic quaternary salts (e.g., benzalkonium chloride, benzyldimethyldodecylammonium chloride, myristyltrime thylammonium bromide, dodecyltrimethylammonium bromide, hexadecylpyridinium chloride, Aliquot 336 (Cognis), benzyldimethylphenylammonium chloride, Crodaquat TES (Croda. Inc.), Rewoquat CPEM (Witco), hexadecyltrimethylammonium p-toluenesulfonate, hexadecyltrimethylammonium hydroxide, 1-methyl-1'-tetradecyl-4,4'-bipyridium dichloride, alkyltrimethylammonium bromide, amprolium hydrochloride, benzethonium hydroxide, benzethonium chloride, benzylditnethylhexadecylammonium chloride, benzyldimethyltetradecylammonium chloride, benzyldodecyldimethylammonium bromide, benzyldodecyldimethylammonium chloride, cetylpyridinium chloride, choline p-toluenesulfonate salt, dimethyldioctadecylammonium bromide, dodecylethyldime thylammonium bromide, dodecyltrimethylammonium chloride, ethylhexadecyldimethylammonium bromide, Girard's reagent, hexadecyl(2-hydroxyethyl)dimethylammonium dihydrogen phosphate, dexadecylpyridinium bromide, hexadecyltrimethylammonium bromide, hexadecyltrimethylammonium chloride, methylbenzethonium chloride, Hyamine® 1622, Luviquat™, N,N',N'-polyoxyethylene (10)-N-tallow-1,3-diaminopropane liquid, oxyphenonium bromide, tetraheptylammonium bromide, tetrakis(decyl)ammonium bromide, thonzonium bromide, tridodecylammonium chloride, trimethyloctadecylammonium bromide, 1-methyl-3-n-octylimidazolium tetrafluoroborate, 1-decyl-3-methylimidazolium tetrafluoroborate. 1-decyl-3-methylimidazolium chloride, tridodecylmethylammonium bromide, dimethyldistearylammonium chloride, cetyltrimethylammonium bromide, myristyltrimethylammonium bromide, and hexamethonium chloride), anionic surfactants (e.g., dodecylbenzenesulfonic acid, sodium dodecylbenzenesulfonate, dodecylphosphonic acid (DDPA), and combinations thereof).

As used herein, the term "passivation agents" refers to compounds which reduce the chemical attack of the low-k layers and to protect the wafer from additional oxidation. Boric acid is one example of a low-k passivating agent, although other hydroxyl additives are known for such purpose, e.g., 3-hydroxy-2-naphthoic acid, malonic acid, iminodiacetic acid, ammonium pentaborate, urea, methyltriethoxysilane and mixtures thereof.

"Substantially devoid" is defined herein in certain embodiments as less than 2 wt. %, less than 1 wt. %, less than 0.5 wt. %, or less than 0.1 wt. %. "Devoid" is intended in certain embodiments to correspond to less than 0.001 wt % to account for environmental contamination, and in another embodiment, 0.0 wt. %.

In some embodiments, the compositions are substantially devoid of (a) corrosion inhibitors; (b) etchants; and (c) passivation agents. In other embodiments, the compositions are devoid of (a) corrosion inhibitors; (b) etchants; and (c) passivation agents.

As is shown below in the Experimental Section, we have found that certain compounds are surprisingly effective in complexing ceria species. Accordingly, in a further aspect, the invention provides a method for complexing ceria which comprises admixing therewith a ceria complexing compound selected from tartaric acid, acetyl acetone, glutamic acid, adipic acid, IDA (iminodiacetic acid), betaine, HEDP and nitrilo triacetic acid at a pH of about 1 to about 6. In other embodiments, a method for complexing ceria which comprises admixing therewith a ceria complexing compound selected from tartaric acid, acetyl acetone, glutamic acid, adipic acid, and nitrilo triacetic acid at a pH of about 4 to about 6.

As used herein, "about" is intended to correspond to +/−0.5% of the stated value.

As used herein, the term "buffer" refers to common buffers such as phosphate salts (e.g., diammonium hydrogen phosphate, ammonium dihydrogen phosphate, ammonium phosphate) and carbonates such as potassium hydrogen carbonate and potassium carbonate. When present, the composition comprises about 0.1 wt % to about 20 wt % buffering species, based on the total weight of the composition.

As used herein, "suitability" for removing ceria particles and CMP contaminants from a microelectronic device having said particles and contaminants thereon corresponds to at least partial removal of said particles/contaminants from the microelectronic device. Cleaning efficacy is rated by the reduction of objects on the microelectronic device. For example, pre- and post-cleaning analysis may be carried out using an atomic force microscope. The particles on the sample may be registered as a range of pixels. A histogram (e.g., a Sigma Scan Pro) may be applied to filter the pixels in a certain intensity (e.g., 231-235) and the number of particles counted. The particle reduction may be calculated using:

$$\text{Cleaning Efficacy} = \frac{\left(\begin{array}{l}\text{Number of PreClean Objects} - \\ \text{Number of PostClean Objects}\end{array}\right)}{\text{Number of PreClean Objects}} \times 100$$

Notably, the method of determination of cleaning efficacy is provided for example only and is not intended to be limited to same. Alternatively, the cleaning efficacy may be considered as a percentage of the total surface that is covered by particulate matter. For example, AFM's may be programmed to perform a z-plane scan to identify topographic areas of interest above a certain height threshold and then calculate the area of the total surface covered by said areas of interest. One skilled in the art would readily understand that the less area covered by said areas of interest post-cleaning, the more efficacious the removal composition. In certain embodiments, at least 75% of the particles/contaminants are removed from the microelectronic device using the compositions described herein, at least 90%, at least 95%, or at least 99% of the particles/contaminants are removed.

Compositions described herein may be embodied in a wide variety of specific formulations, as hereinafter more fully described.

In all such compositions, wherein specific components of the composition are discussed in reference to weight percentage ranges including a zero lower limit, it will be understood that such components may be present or absent in various specific embodiments of the composition, and that in instances where such components are present, they may be present at concentrations as low as 0.00001 weight percent, based on the total weight of the composition in which such components are employed.

In order to adjust the pH to the desired endpoint, basic compounds such as choline hydroxide may be utilized.

Additionally, the compositions may contain other additives as desired, such as surfactants.

As used herein the term "surfactant" refers to an organic compound that lowers the surface tension (or interfacial tension) between two liquids or between a liquid and a solid, typically an organic amphiphilic compound that contains a hydrophobic group (e.g., a hydrocarbon (e.g., alkyl) "tail") and a hydrophilic group. When present, surfactants for use in the compositions described herein include, but are not limited to, amphoteric salts, cationic surfactants, anionic surfactants, zwitterionic surfactants, non-ionic surfactants, and combinations thereof including, but not limited to, decylphosphonic acid, dodecylphosphonic acid (DDPA), tetradecylphosphonic acid, hexadecylphosphonic acid, bis (2-ethylhexyl)phosphate, octadecylphosphonic acid, perfluoroheptanoic acid, prefluorodecanoic acid, trifluoromethanesulfonic acid, phosphonoacetic acid, dodecylbenzenesulfonic acid (DDBSA), other R1 benzene sulfonic acids or salts thereof (where the $R^1$ is a straight-chained or branched $C_8$-$C_{18}$ alkyl group), dodecenylsuccinic acid, dioctadecyl hydrogen phosphate, octadecyl dihydrogen phosphate, dodecylamine, dodecenylsuccinic acid monodiethanol amide, lauric acid, palmitic acid, oleic acid, juniperic acid, 12 hydroxystearic acid, octadecylphosphonic acid (ODPA), dodecyl phosphate. Non-ionic surfactants contemplated include, but are not limited to, polyoxyethylene lauryl ether, dodecenylsuccinic acid monodiethanol amide, ethylenediamine tetrakis (ethoxylate-block-propoxylate) tetrol, polyethylene glycols, polypropylene glycols, polyethylene or polypropylene glycol ethers, block copolymers based on ethylene oxide and propylene oxide, polyoxypropylene sucrose ether, t-octylphenoxypolyethoxyethanol, 10-ethoxy-9,9-dimethyldecan-1-amine, Polyoxyethylene (9) nonylphenylether, branched, Polyoxyethylene (40) nonylphenylether, branched, dinonylphenyl polyoxyethylene, nonylphenol alkoxylates, polyoxyethylene sorbitol hexaoleate, polyoxyethylene sorbitol tetraoleate, polyethylene glycol sorbitan monooleate, sorbitan monooleate, alcohol alkoxylates, alkyl-polyglucoside, ethyl perfluorobutyrate, 1,1,3,3,5,5-hexamethyl-1,5-bis[2-(5-norbornen-2-yl)ethyl]trisiloxane, monomeric octadecylsilane derivatives, siloxane modified polysilazanes, silicone-polyether copolymers, and ethoxylated fluorosurfactants. Cationic surfactants contemplated include, but are not limited to, cetyl trimethylammonium bromide (CTAB), heptadecanefluorooctane sulfonic acid, tetraethylammonium, stearyl trimethylammonium chloride, 4-(4-diethylaminophenylazo)-1-(4-nitrobenzyl)pyridium bromide, cetylpyridinium chloride monohydrate, benzalkonium chloride, benzethonium chloride benzyldimethyldodecylammonium chloride, benzyldimethylhexadecylammonium chloride, hexadecyltrimethylammonium bromide, dimethyldioctadecylammonium chloride, dodecyltrimethylammonium chloride, hexadecyltrimethylammonium p-toluenesulfonate, didodecyldimethylammonium bromide, di(hydrogenated tallow)dimethylammonium chloride, tetraheptylammonium bromide, tetrakis(decyl)ammonium bromide, and oxyphenonium bromide, guanidine hydrochloride (C(NH2) 3Cl) or triflate salts such as tetrabutylammonium trifluoromethanesulfonate, dimethyldioctadecylammonium chloride, dimethyldihexadecylammonium bromide, di(hydrogenated tallow) dimethylammonium chloride, and polyoxyethylene (16) tallow ethylmonium ethosulfate. Anionic surfactants contemplated include, but are not limited to, poly(acrylic acid sodium salt), ammonium polyacrylate, sodium polyoxyethylene lauryl ether, sodium dihexylsulfosuccinate, sodium dodecyl sulfate, dioctylsulfosuccinate salt, 2-sulfosuccinate salts, 2,3-dimercapto-1-propanesulfonic acid salt, dicyclohexyl sulfosuccinate sodium salt, sodium 7-ethyl-2-methyl-4-undecyl sulfate, phosphate fluorosurfactants, fluorosurfactants, and polyacrylates. Zwitterionic surfactants include, but are not limited to, acetylenic diols or modified acetylenic diols, ethylene oxide alkylamines, N,N-dimethyldodecylamine N-oxide, sodium cocaminpropinate, 3-(N,N-dimethylmyristylammonio)propanesulfonate, and (3-(4-heptyl)phenyl-3-hydroxypropyl)dimethylammoniopropanesulfonate.

With regard to compositional amounts, the weight percent ratios of other additive(s) to components (a), (b), (c), (d), (e) is in one embodiment, in a range from about 0.001:1 to about 10:1, and in other embodiments, about 0.1:1 to about 5:1. The amount of the pH adjusting agent is dependent on the final pH sought when preparing the removal composition for use, based on the pH values disclosed herein, and the knowledge of the person skilled in the art.

The range of weight percent ratios of the components will cover all possible concentrated or diluted embodiments of the composition. Towards that end, in one embodiment, a concentrated removal composition is provided that can be diluted for use as a cleaning solution. A concentrated composition, or "concentrate," advantageously permits a user (e.g. a CMP process engineer) to dilute the concentrate to the desired strength and pH at the point of use. Dilution of the concentrated aqueous composition may be in a range from about 1:1 to about 49:1, or about 1:1 to about 100:1, wherein the aqueous composition is diluted at or just before the tool with solvent, e.g., deionized water. It is to be appreciated by one skilled in the art that following dilution, the range of weight percent ratios of the components disclosed herein should remain unchanged.

In terms of substrates, the compositions of the invention are believed to be useful in cleaning low k dielectric materials as set forth herein.

In yet another embodiment, the compositions described herein further comprise ceria particles and/or CMP contaminants. The ceria particles and contaminants become a component of the composition after cleaning has begun and will be dissolved and/or suspended in the compositions.

The removal compositions are easily formulated by simple addition of the respective ingredients and mixing to homogeneous condition. Furthermore, the compositions may be readily formulated as single-package formulations or multi-part formulations that are mixed at or before the point of use, e.g., the individual parts of the multi-part formulation may be mixed at the tool or in a storage tank upstream of the tool. The concentrations of the respective ingredients may be widely varied in specific multiples of the composition, i.e., more dilute or more concentrated, and it will be appreciated that the compositions described herein can variously and alternatively comprise, consist or consist essentially of any combination of ingredients consistent with the disclosure herein.

As applied to microelectronic manufacturing operations, the compositions described herein are usefully employed to clean ceria particles and/or CMP contaminants (e.g., post-CMP residue and contaminants) from the surface of the microelectronic device. In certain embodiments, the aqueous removal compositions remove at least 85% of the ceria particles present on the device prior to particle removal, at least 90%, at least 95%, or at least 99%.

In post-CMP particle and contaminant removal applications, the aqueous removal composition described herein may be used with a large variety of conventional cleaning tools such as megasonics and brush scrubbing, including, but not limited to, Verteq single wafer megasonic Goldfinger, OnTrak systems DDS (double-sided scrubbers), SEZ or other single wafer spray rinse, Applied Materials Mirra-Mesa™/Reflexion™/Reflexion LK™, and Megasonic batch wet bench systems.

In use of the compositions described herein for removing ceria particles and CMP contaminants from microelectronic devices having same thereon, the aqueous removal composition typically is contacted with the device for a time of from about 5 seconds to about 10 minutes, or about 1 sec to 20 min, or about 15 sec to about 5 minutes at temperature in a range of from about 20° C. to about 90° C., or about 20° C. to about 50° C. Such contacting times and temperatures are illustrative, and any other suitable time and temperature conditions may be employed that are efficacious to at least partially remove the ceria particles and CMP contaminants from the device, within the broad practice of the method. "At least partially clean" and "substantial removal" both correspond in certain embodiments to at removal of at least 85% of the ceria particles present on the device prior to particle removal, at least 90%, at least 95%, or at least 99%.

Following the achievement of the desired particle removal action, the aqueous removal composition may be readily removed from the device to which it has previously been applied, as may be desired and efficacious in a given end use application of the compositions described herein. In one embodiment, the rinse solution includes deionized water. Thereafter, the device may be dried using nitrogen or a spin-dry cycle.

Yet another aspect relates to the improved microelectronic devices made according to the methods described herein and to products containing such microelectronic devices.

Another aspect relates to a recycled aqueous removal composition, wherein the removal composition may be recycled until particle and/or contaminant loading reaches the maximum amount the aqueous removal composition may accommodate, as readily determined by one skilled in the art.

A still further aspect relates to methods of manufacturing an article comprising a microelectronic device, said method comprising contacting the microelectronic device with an aqueous removal composition for sufficient time to remove ceria particles and CMP contaminants from the microelectronic device having said particles and contaminants thereon, and incorporating said microelectronic device into said article, using a removal composition described herein.

In another aspect, a method of removing ceria particles and CMP contaminants from a microelectronic device having same thereon is provided. Accordingly, in another aspect, the invention provides a method for removing ceria particles and chemical mechanical polishing contaminants from a microelectronic device having said particles and contaminants thereon, said method comprising:

(i) contacting the microelectronic device with the composition of the invention; and (ii) at least partially removing said particles and contaminants from said microelectronic device with an aqueous solution comprising deionized water.

This invention can be further illustrated by the following examples of preferred embodiments thereof, although it will be understood that these examples are included merely for purposes of illustration and are not intended to limit the scope of the invention unless otherwise specifically indicated.

EXPERIMENTAL SECTION

A fixed amount of CeO2-slurry was added into each diluted composition. The mixture was stirred for same amount of time for each composition. It was filtered and solid residue was separated from solution. The dissolved Ceria-ion in solution was measured via ICP-OES method.

| Citric = 1% + Ascorbic = 6% +Additive | |
|---|---|
| 2% | Additive |
| Example 1 | nitrilo triacetic acid |
| Example 2 | Betaine |
| Example 3 | Glutamic acid |
| Example 4 | malic acid |
| Example 5 | EDTA |
| Example 6 | pentetic acid |
| Example 7 | adipic acid |
| Example 8 | citric acid |
| Example 9 | tartaric acid |
| Example 10 | Acetyl Acetone |
| Example 11 | triethylene glycol monobutyl ether |
| Example 12 | oxalic acid |
| Example 13 | Phtalic acid |
| Example 14 | Fumaric acid |

Supporting Data ICP-OES Data of Dissolution

| Example | % of added Ceria |
|---|---|
| Example 1 | 1.52 |
| Example 2 | 2.76 |
| Example 3 | 0.95 |
| Example 4 | 2.73 |
| Example 5 | 1.06 |
| Example 6 | 1.35 |
| Example 7 | 0.91 |
| Example 8 | 1.22 |
| Example 9 | 1.29 |
| Example 10 | 2.78 |
| Example 11 | 1.74 |
| Example 12 | 0.40 |
| Example 13 | 1.20 |
| Example 14 | 1.02 |

| Citric acid = 1% + DEHA = 1% + TGME = 2.5% | |
|---|---|
| Example 15 | IDA |
| Example 16 | HEDP |
| Citric acid = 1% + H3PO2 = 1% + TGME = 2.5% | |
| Example 17 | Betaine |
| Example 18 | HEDP |

| Example | % of added Ceria |
|---|---|
| Example 15 | 1.22 |
| Example 16 | 2.75 |
| Example 17 | 1.13 |
| Example 18 | 3.09 |

The invention claimed is:

1. A composition having a pH of about 1 to about 6, comprising:

(a) a cerium-oxygen bond breaking compound;

(b) a pH adjustor;

(c) at least one cleaning agent;

(d) a ceria complexing compound selected from tartaric acid, acetyl acetone, glutamic acid, adipic acid, betaine, nitrilo triacetic acid, iminodiacetic acid (IDA), etidronic acid (HEDP), and amino tris(methylenephosphonic acid); and (e) water, wherein the pH of the composition is about 1 to about 6.

2. The composition of claim 1, wherein cerium-oxygen bond breaking compound is selected from nucleophilic compounds, oxidizing agents, and reducing agents.

3. The composition of claim 1, wherein the pH adjustor is chosen from choline hydroxide, potassium hydroxide, cesium hydroxide, tetraethylammonium hydroxide, ammonium hydroxide, nitric acid, sulfuric acid, sulfamic acid, glycolic acid, lactic acid, and methanesulfonic acid.

4. The composition of claim 1, wherein the ceria complexing compound is amino tris(methylenephosphonic acid).

5. The composition of claim 1, wherein the ceria complexing compound is acetyl acetone.

6. The composition of claim 1, wherein the ceria complexing compound is iminodiacetic acid.

7. The composition of claim 1, wherein the ceria complexing compound is adipic acid.

8. The composition of claim 1, wherein the ceria complexing compound is etidronic acid.

9. The composition of claim 1, wherein the ceria complexing compound is betaine.

10. The composition of claim 1, wherein the cleaning agent is selected from water-miscible organic solvents and polymers.

11. The composition of claim 1, wherein the cleaning agent is citric acid.

12. A method for complexing ceria which comprises admixing therewith a ceria complexing compound selected from tartaric acid, acetyl acetone, glutamic acid, adipic acid, betaine, nitrilo triacetic acid, iminodiacetic acid (IDA), etidronic acid (HEDP), and amino tris(methylenephosphonic acid) at a pH of about 4 to about 6.

13. The method of claim 12, wherein the ceria complexing compound is amino tris(methylenephosphonic acid).

14. The method of claim 12, wherein the ceria complexing compound is acetyl acetone.

15. The method of claim 12, wherein the ceria complexing compound is iminodiacetic acid.

16. The method of claim 12, wherein the ceria complexing compound is adipic acid.

17. The method of claim 12, wherein the ceria complexing compound is etidronic acid.

18. The method of claim 12, wherein the ceria complexing compound is nitrilo triacetic acid.

19. The method of claim 12, wherein the ceria complexing compound is betaine.

20. A composition having a pH of about 1 to about 6, comprising:

(a) a cerium-oxygen bond breaking compound;

(b) a pH adjustor;

(c) at least one cleaning agent;

(d) a ceria complexing compound selected from acetyl acetone, betaine, nitrilo triacetic acid, and amino tris (methylenephosphonic acid); and (e) water.

* * * * *